United States Patent [19]

Diesener

[11] Patent Number: 5,027,849

[45] Date of Patent: Jul. 2, 1991

[54] GASOLINE STATION INSTALLATION

[76] Inventor: Gerhard Diesener, Box 32, R.D. 1, Martinsville, N.J. 08836

[21] Appl. No.: 399,970

[22] Filed: Aug. 29, 1989

[51] Int. Cl.[5] ..... B67D 5/60; B65D 90/22; F17D 1/08

[52] U.S. Cl. ..... 137/236.1; 220/85 S; 220/4.12; 220/476

[58] Field of Search ..... 405/53, 54; 222/52, 222/53, 130, 131; 137/234.6, 236.1; 220/5 A, 18, 85 S, 408, 469

[56] References Cited

U.S. PATENT DOCUMENTS

| | | | |
|---|---|---|---|
| 3,288,321 | 11/1966 | Wokas | 220/85 S X |
| 3,712,502 | 1/1973 | Basier et al. | 220/5 A X |
| 4,131,216 | 12/1978 | Gerstenmaier et al. | 222/52 |
| 4,638,920 | 1/1987 | Goodhues, Jr. | 220/85 S X |
| 4,639,164 | 1/1987 | Pugnale et al. | 220/18 X |
| 4,685,327 | 8/1987 | Sharp | 220/469 X |
| 4,911,326 | 3/1990 | McGouran, Jr. | 220/85 S |
| 4,912,966 | 4/1990 | Sharp | 220/469 X |

FOREIGN PATENT DOCUMENTS

| | | | |
|---|---|---|---|
| 593833 | 3/1960 | Canada | 137/234.6 |

*Primary Examiner*—Andres Kashnikow
*Assistant Examiner*—William Grant
*Attorney, Agent, or Firm*—Horst M. Kasper

[57] ABSTRACT

A gasoline station installation unit is comprised of a tank, piping, pump, and dispensing apparatus. The installation unit also comprises catch-all sumps which include detector systems for the detection of leakage of pumps and dispensing apparatus.

6 Claims, 3 Drawing Sheets

GASOLINE STATION INSTALLATION

BACKGROUND OF THE INVENTION

1. Field of the Invention

The invention relates to a gasoline station installation of a tank and supply lines.

2. Brief Description of the Background of the Invention Including Prior Art

The efforts to protect the environment have placed increased demands on storage and dispensing devices for gasoline and similar hydrocarbon products. Substantial insurance requirements are imposed on gas station owners for possible fuel spills. Therefore, gas station owners desire to obtain tanks with at least a 30-year warranty against corrosion and structural failure. Further, there is a need to adapt tanks, piping, and dispensers to the new requirements for protecting the environment against spills and leakages. Consideration has been given to double-wall tanks and piping, alarm systems, and new product dispensers.

Consequently, it is desirable to provide a tank, piping, and a dispenser system which exhibit an adequate protection and enhanced safety in order to decrease any possibility of a spill. Furthermore, federal regulations in effect now and regulations yet to be implemented have to be addressed and satisfied.

SUMMARY OF THE INVENTION

1. Purposes of the Invention

It is an object of the invention to provide a gas station installation system which is safe against fuel spills.

It is another purpose of the invention to provide a self-contained unit which does not require detailed assembly steps while being installed at the location of a gasoline station.

It is yet another object of the present invention to provide a gasoline station installation which minimizes pipe joints subject to corrosion and to leakage into the environment.

It is an object of the invention to achieve a security of the outlined tank installation, where the tank, piping, pump, and dispensing apparatus is a unit, which contains a fluid hydrocarbon product to be dispensed in a safe manner.

These and other objects and advantages of the present invention will become evident from the description which follows.

2. Brief Description of the Invention

The present invention provides for a gas service station installation comprising a fuel storage tank. A submersible pump is disposed inside the fuel storage tank. A pump rise pipe is connected to the submersible pump. A horizontal feed line is provided for fluid product. A horizontal pipe connection section connects the rise pipe to the horizontal pipe. A containment box is welded to the outside of the tank. An opening cover is disposed at the top of the tank above the submersible pump. A containment box is welded at the end of the tank opposite to the location of the submersible pump to the top of the fuel tank. A dispenser rise pipe is connected to the horizontal pipe. A vent and vapor return pipe is disposed inside the containment box. A filling and gas supply connection is disposed at the end of the tank opposite to the fuel pump for supplying the fuel tank with a fluid material.

A separating compartment wall can separate the tank into two sections. A second submersible pump can be disposed inside the fuel storage tank. A second pump rise pipe can be connected to the submersible pump. A second horizontal feed line can be provided for fluid product. A second horizontal pipe connection section can connect the rise pipe to the horizontal pipe. A second containment box can be welded to the outside of the tank. A second opening cover can be disposed at the top of the tank above the submersible pump. A second containment box can be welded at the end of the tank opposite to the location of the submersible pump to the top of the fuel tank. A second dispenser rise pipe can be connected to the horizontal pipe. A second vent and vapor return pipe can be disposed inside the containment box. A second filling and gas supply connection can be disposed at the end of the tank opposite to the fuel pump for supplying the fuel tank with a fluid material.

The horizontal pipes can be disposed next to each other and can be connected by a flexible hose to the corresponding rise pipe in the containment box. The horizontal pipes can be connected with a flexible hose to the rise pipe of the submersible pump.

A tank monitoring well can be disposed next to the fuel tank.

A multiple product dispenser can be attached to the containment box and to the dispenser rise pipe.

The invention tank is, of course, the main component of the installation unit. Said unit also comprises catch-all sumps which include detector systems for leakage of pumps and dispensing apparatus.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
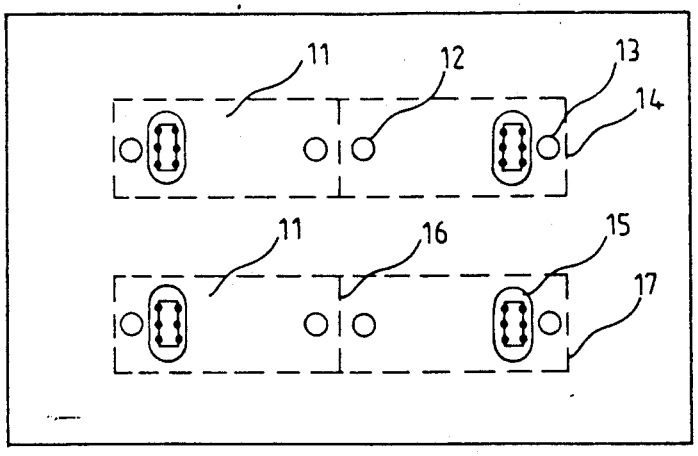
FIG. 1 is a schematic plan view of a gas station installation with two aisles.

Referring now to FIG. 1, there is shown a general outlay of a gas station in a plan view. There are illustrated two 12,000-gallon tanks 11. Each tank has a diameter of 96 inches and a length of 32 feet and a double wall. Each tank has two compartments separated by a separating inner wall 16. The tanks can be emptied each with a submersible pump 26, 27, disposed close to the separating inner wall 16 for separating the tank 11 into two compartments. Each compartment in general carries a different product. The submersible pumps 26, 27 are contained in the tank and below an opening protected with a cover 12 for accessing the submersible pumps 26, 27 at the top. Filling connections with vapor coaxial drop tube 88 and surface manhole cover 86 for filling the tanks 11 are schematically illustrated at 13 (compare also FIG. 6) and are disposed at the two longitudinal ends of the tanks 11. A tank monitoring well 14 is furnished on one end of each tank closely spaced but outside of the tanks. The monitoring well 14 is furnished with a surface access and contains a manhole opening 84. The multiple product dispenser 15 is disposed close to the end of the tank as seen in projection immediately neighboring the filling connection 13. The multiple product dispenser 15 generally comprises two product supply lines 43 and a mixer 66 for obtaining a third product, including a containment box 68 and a multiple product dispenser support frame 74. This multiple product dispenser 15 is installed on the dog-bone island. The separating wall forming the head of the compartment is illustrated schematically at 16. The drive to drive around the aisles is provided on a pad 17.

Figure 2:
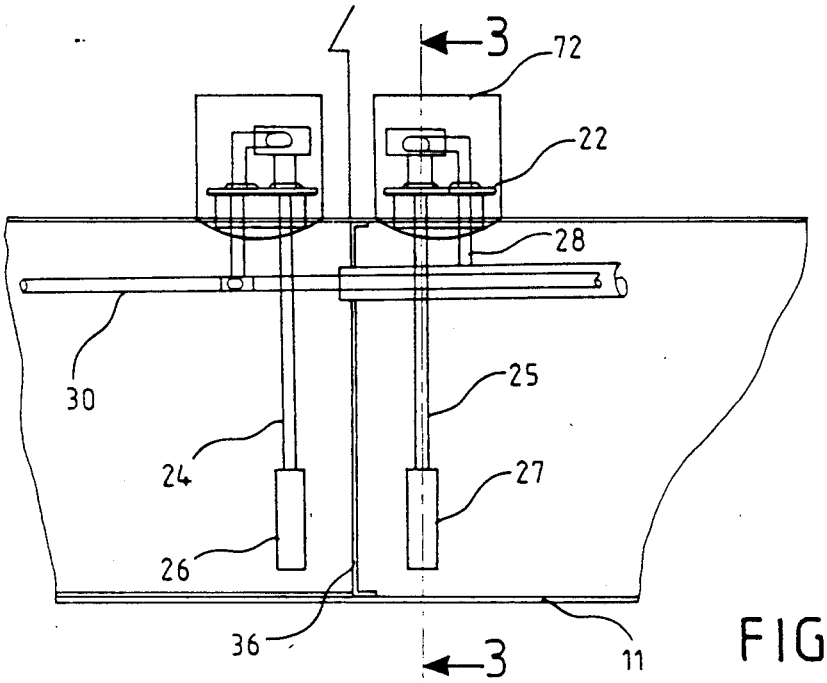
FIG. 2 is a schematic sectional view of a dual fuel tank for a gasoline service station in the area of a separating wall with the gasoline pump installation.

FIG. 2 illustrates the area of the pumps. The manhole cover of the access to the pump is designated with reference numeral 72. Below the cover 72 there is disposed an installation plate 22 which is adapted for attachment of pipes. One pipe 24 is connected to the submersible pump 26 and one pipe 25 is connected to the submersible pump 27. A rising pipe 28 is connected to a substantially horizontal pipe 30 feeding product to the multiple product dispenser 15. The submersible pump 26, 27 is disposed close to the bottom of the tank. The distance of the pump 26, 27 from the bottom is approximately half the distance of the pump 26, 27 from the compartment separating wall 36.

Figure 3:
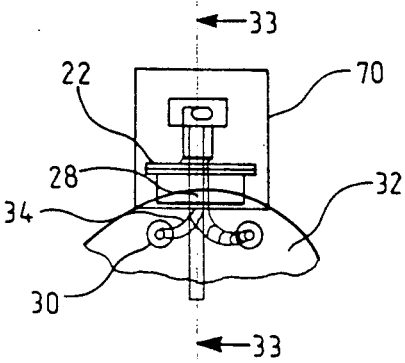
FIG. 3 is a sectional view according to section line 3—3 of FIG. 2 in the area of a service opening for the pump.

FIG. 3 illustrates the sectional view, along section line 3—3 of FIG. 2. It can be seen that there are two horizontal pipes 30, 32 which are each connected to one respective pump 26, 27. FIG. 3 illustrates in particular the attachment of the platform 22 onto the tank as well as the disposition of the protecting container 70 disposed over the piping connection. The protecting container 70 is specially welded to the tank 11 in order to avoid any possible leakage of hydrocarbon fluid into the environment. Preferably, the connection between the horizontal pipe 30 and rising pipe 28 is furnished by a flexible hose 34.

Figure 4:
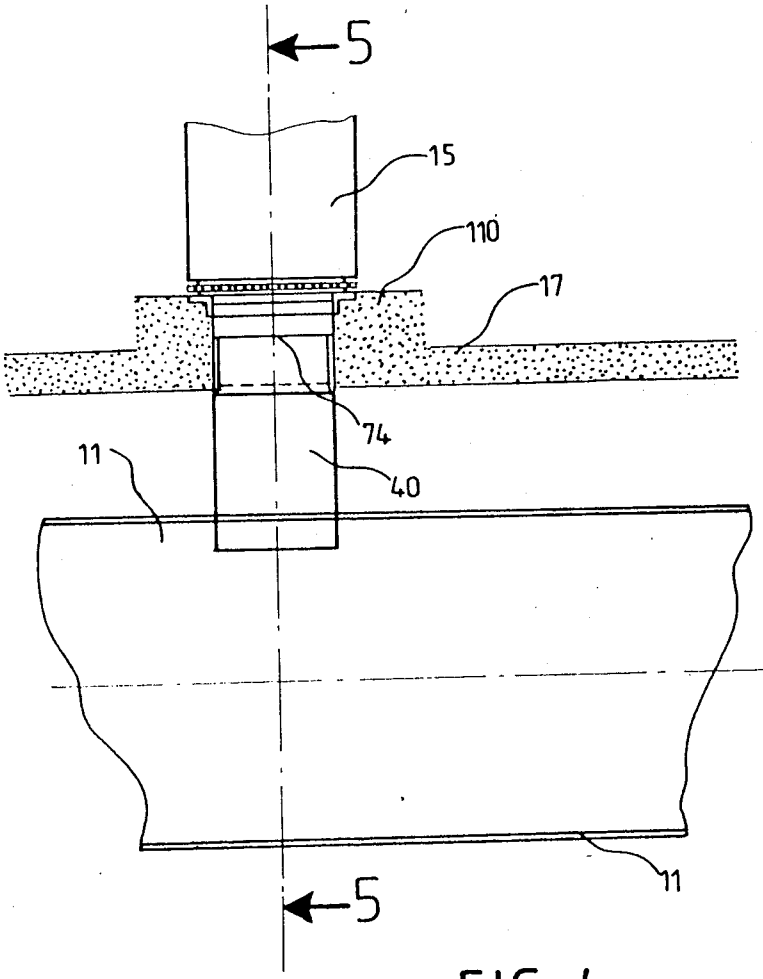
FIG. 4 is a schematic sectional view of the tank and its connection to the multiple product dispenser.

FIG. 4 illustrates the positioning of the multiple product dispenser 15 on the island 110 in the area of the drive on a pad 17. The multiple product dispenser 15 is attached to a sleeved multiple product dispenser support frame 74 to straddle the tank wall 81 to provide sealing and movement, if required. The connection can be provided, for example, by an 18 inch×48 inch rectangular container well 40, sitting on the tank 11 and connected to the multiple product dispenser 15.

Figure 5:
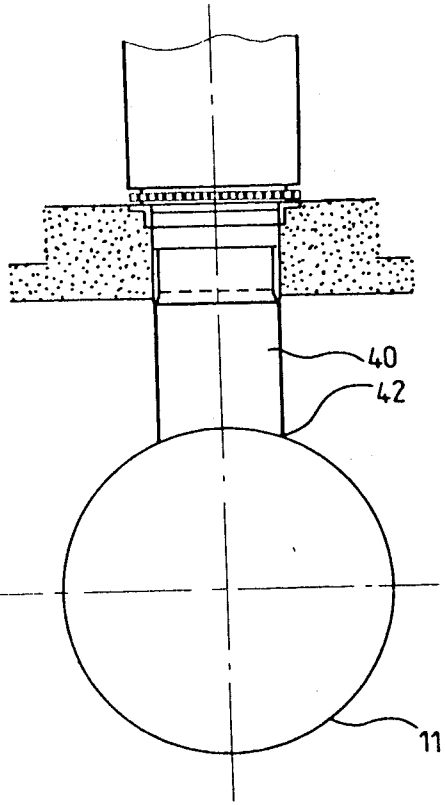
FIG. 5 is a sectional view along section line 5—5 of FIG. 4 of the tank and the multiple product dispenser.

FIG. 5 illustrates an end view of the embodiment of FIG. 4 showing the larger width of the rectangular container well 40 attached to the tank 11 by the weld 42.

Figure 6:
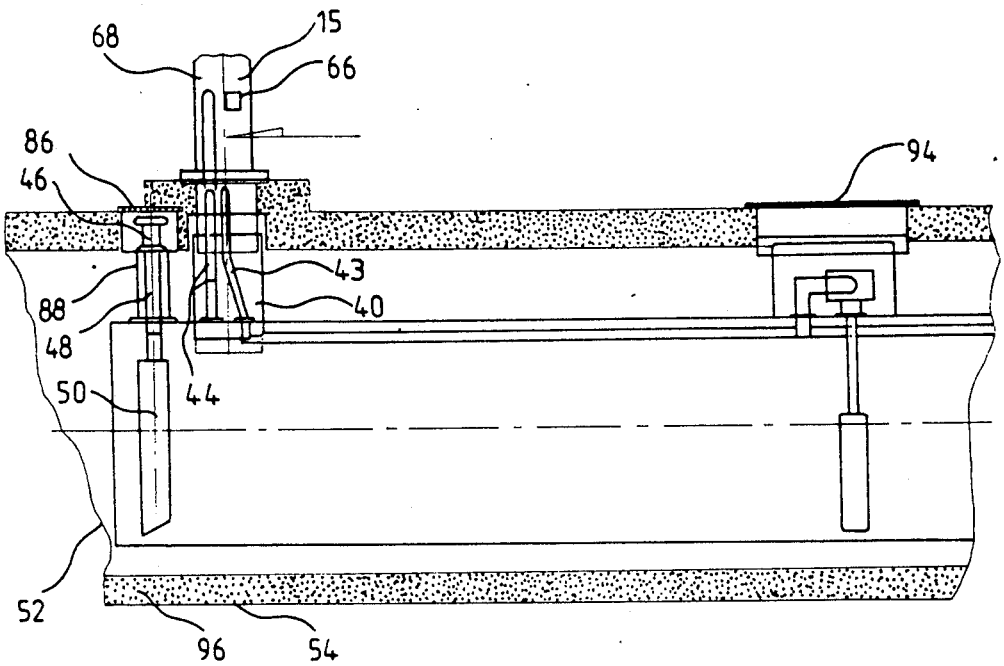
FIG. 6 is another embodiment illustrating the connection between the pumping section and the multiple product dispenser as well as the installation surrounding of the tank.

FIG. 6 illustrates some of the supply lines 43, 44 running through the rectangular container well 40. Furthermore, the filling section with the filling head 46, the filling pipe 48 and the supply discharge section 50 inside the container can be recognized in more detail. The gas tank is surrounded by a sand-back-fill 52, illustrated in FIG. 6, which sand-back-fill 52 is disposed between the tank 11 and a concrete pad 54 disposed below the tank 11.

The pipe 44 represents a combination of a vent pipe and a vapor return. The submersible pump 26, 27 can be a standard red jacketed submersible pump. The tank 11 is preferably a double-wall buffhide tank with a 30-year warranty against corrosion and structural failure, which can be installed according to the manufacturer's recommendation and the federal regulations. The tank 11 is to be equipped with a manhole opening 94 for internal inspection. Piping is to be fabricated for assembling the overall product in a controlled fashion. Each sump space and intersticial space is to be equipped with an electrical alarm for detection of water, gasoline, or hydrocarbon vapors.

Figure 7:
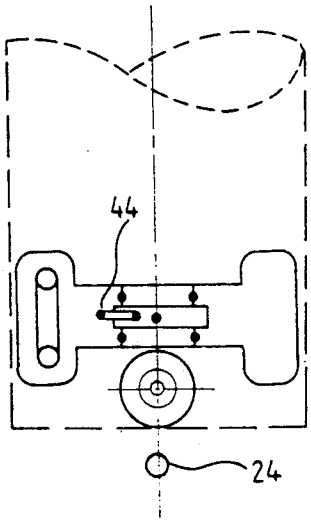
FIG. 7 is a detailed view of the embodiment of FIG. 6 in the area of the connection to the multiple product dispenser.

FIG. 7 illustrates in an enlarged view the section of FIG. 6, providing the connection to the multiple product dispenser 15. The pipe 44 combining a vent and vapor return can be recognized in more detail in its connection section. The horizontal pipe 30 is solidly connected to the rising pipe 42.

Figure 8:
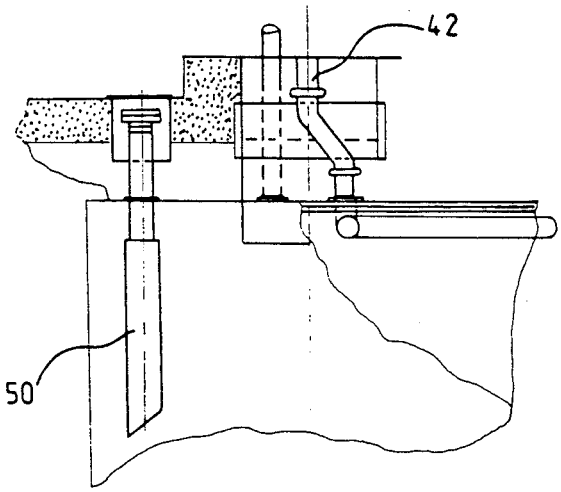
FIG. 8 is an enlarged view of an embodiment similar to the embodiment of FIG. 1 in the area of the dispenser and the filling connection.

FIG. 8 illustrates the disposition of the multiple product dispenser 15 above the tank. This is a 4-hose single product dispenser with vapor return. The vent is illustrated on the left-hand side of the figure. A product line runs in the center of the multiple product dispenser 15. There is further seen in this figure, a more detailed schematic top view of the filling and supply connection for the hydrocarbon delivered by the distributor with a vapor coaxial drop tube and a contained manhole opening. There are further provided opposite side tank gasoline and intersticial monitoring connections 150 in the area of the filling pipe 48.

The tank or tanks 11 are installed perpendicular to the drive on concrete pads 96 and the multiple product dispensers 15 are to be disposed directly under the fuel operation. The islands 110 have a spacing of, for example, approximately 26 feet center to center. Each tank 11 is approximately 32 feet long and each has two compartments, with each tank having a total capacity of approximately 12,000–15,000 gallons. Each multiple product dispenser can be supplied with two products from the tank beneath, and the two products can be mixed in a desired ratio to produce a third product. The filling, gauge, and monitoring elements are similar to those used in conventional gas station tank equipment.

According to the present invention, the product is supplied from the tank 11 to the dispenser 15 by a piping 30, 32 going through and to the inside of the tank 11. Thus, the tank 11 is used as a containment chamber for the piping 30, 32. This allows to minimize joints exposed to the outside conditions of corrosion and mechanical breakage.

The compartment tank 11 preferably stores two products and is fitted with two rectangular boxes 40 contoured to the tank of a size of about 18 inches parallel to the axis of the tank 11, 40 inches horizontal extension perpendicular to the axis of the pipe, and a height of 24 inches. This rectangular box 40 is welded to the tank 11 perpendicularly and symmetrically to its longitudinal center line, at a distance of approximately 26 feet apart from such box 40 on the other end. The rectangular boxes 40 act as a containment chamber for the external supply lines and their extension sleeve frame 74 to the surface grade as a support frame for the multiple product dispenser 15. The internal area can receive a 4-inch threaded pipe stub, with internal piping to the opposite compartment of the tank, which piping functions as a vapor return. The product can be separated and the internal product line serves as a containment means versus the surrounding other product. The internal separating wall 36 serves as a containment chamber for each product. This holds for each of the two compartments. An additional two 2-inch diameter couplings are installed to handle the vent, vapor return, and gasoline supply of the multiple product dispenser 15 from the tank 11 below.

Two 16-inch diameter manhole openings 94 are installed about 48 inches apart to the left and the right of the tank's bulkhead, and each has a well of a diameter of about 24 inches and a height of about 24 inches, welded to the tank acting as containment chambers to the manhole openings. The manhole openings are to receive the red jacket submersible pumps installed in 4-inch fittings and a flanged fitting with a flexible hose to supply the internal line with the product. These fittings can be installed in the manhole cover plate, which cover plate is removable in order to facilitate internal pipe installation and inspection. Each of the four containment chambers is equipped with monitoring alarm systems, such as presently employed in the industry, and a lid or cover 86 and a surface manhole opening 84 completes the installation. Each end of the tank is equipped with standard filling, gauging, and intersticial monitoring connections.

The advantage of the invention tanks is that the storage elements do not need to be separated from the dispensing elements, since the tanks of this novel design may have a lifetime of fifty years. The main reasons for this extended lifetime is the additional protection against electrolysis, which protects against external corrosion, and the installation of a manhole for internal inspection. The construction of the piping system assures product line control and a virtually safe handling. The dispenser containment spill box contributes to the total product containment control.

It will be understood that each of the elements described above, or two or more together, may also find a useful application in other types of fluid storage and supply systems differing from the types described above.

While the invention has been illustrated and described as embodied in the context of a gasoline station installation, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Gas service station installation comprising: a fuel storage tank;

a submersible pump disposed inside the fuel storage tank;

a protecting container welded to the fuel storage tank above the submersible pump;

a pump rise pipe connected to the submersible pump and extending into said protecting container;

a horizontal feed line pipe disposed entirely within the fuel storage tank for fluid product;

a horizontal pipe connection section including a flexible hose, connecting the rise pipe to the horizontal pipe;

a containment box welded to the outside of the tank at the end of the tank opposite to the location of the submersible pump to the top of the fuel tank;

an opening cover disposed at the top of the tank above the submersible pump;

a dispenser rise pipe connected to the horizontal pipe;

a vent and vapor return pipe disposed inside the containment box;

a filling and gas supply connection disposed at the end of the tank opposite to the submersible pump for supplying the fuel tank with fluid product.

2. The gas station installation according to claim 1, further comprising:

a separating compartment wall, separating the tank into two sections;

a second submersible pump disposed inside the fuel storage tank;

a second pump rise pipe connected to the second submersible pump;

a second horizontal feed line pipe for fluid product;

a second horizontal pipe connection section, connecting the second rise pipe to the second horizontal pipe;

a second containment box welded to the outside of the tank at the end of the tank opposite to the location of the second submersible pump to the top of the fuel tank;

a second opening cover disposed at the top of the tank above the second submersible pump;

a second dispenser rise pipe connected to the second horizontal pipe;

a second vent and vapor return pipe disposed inside the second containment box;

a second filling and gas supply connection disposed at the end of the tank opposite to the second submersible pump for supplying the fuel tank with fluid product.

3. The gas station installation according to claim 2, wherein the horizontal pipes are disposed next to each other.

4. The gas station installation according to claim 2, wherein the second horizontal pipe is connected with a flexible hose to the second rise pipe of the second submersible pump.

5. The gas station installation according to claim 2, further comprising a tank monitoring well disposed next to the fuel tank.

6. The gas station installation according to claim 1, further comprising a multiple product dispenser attached to the containment box and to the dispenser rise pipe.

* * * * *

UNITED STATES PATENT AND TRADEMARK OFFICE

CERTIFICATE OF CORRECTION

PATENT NO. : 5,027,849

DATED : July 2, 1991

INVENTOR(S) : Gerhard Diesener

It is certified that error appears in the above-identified patent and that said Letters Patent is hereby corrected as shown below:

On the title page, item [54] and in column 1, line 2, delete the title "GASOLINE STATION INSTALLATION" and insert --TOTAL PRODUCT CONTROL GASOLINE STATION INSTALLATION--.

Signed and Sealed this

Twentieth Day of October, 1992

*Attest:*

DOUGLAS B. COMER

*Attesting Officer*

*Acting Commissioner of Patents and Trademarks*